United States Patent [19]

Hawkins

[11] 4,442,766

[45] Apr. 17, 1984

[54] MOBILE CRUSHER VEHICLE

[76] Inventor: Peter A. T. Hawkins, White Cross Farm, Cholsey, Oxfordshire, England

[21] Appl. No.: 326,421

[22] Filed: Dec. 1, 1981

[30] Foreign Application Priority Data

Dec. 5, 1980 [GB] United Kingdom ..... 8039004
Jun. 26, 1981 [GB] United Kingdom ..... 8119865

[51] Int. Cl.[3] ..... B30B 9/32

[52] U.S. Cl. ..... 100/35; 100/91; 100/100; 100/215; 100/218; 100/233; 100/901

[58] Field of Search ..... 100/100, 901, 215, 91, 100/218, 233, 269 R, 295

[56] References Cited

U.S. PATENT DOCUMENTS

| | | | |
|---|---|---|---|
| 2,875,912 | 3/1959 | Thresher | 100/100 X |
| 3,242,851 | 3/1966 | Brawley | 100/100 X |
| 3,266,413 | 8/1966 | Sharp et al. | 100/233 |
| 3,273,493 | 9/1966 | Smiltneek | 100/901 X |
| 3,275,172 | 9/1965 | Smith . | |
| 3,486,440 | 12/1969 | Schaffler | 100/233 |
| 3,651,754 | 3/1972 | Forest | 100/901 X |
| 3,942,430 | 3/1976 | Day | 100/233 |

FOREIGN PATENT DOCUMENTS

| | | | |
|---|---|---|---|
| 223602 | 8/1959 | Australia | 100/100 |
| 2125543 | 12/1972 | Fed. Rep. of Germany . | |
| 373065 | 1/1975 | Sweden | 100/233 |

*Primary Examiner*—Billy J. Wilhite
*Attorney, Agent, or Firm*—Bacon and Thomas

[57] ABSTRACT

A mobile vehicle for crushing scrap metal, especially for flattening car body shells, has a crusher jaw mechanism (11) carried ahead of a generally conventional vehicle body (12). The jaw includes a press plate (55) above a platform (31). The car body shell (90) is loaded on to the platform by advancing the vehicle towards the body shell and driving the platform under the shell, and is then crushed between the press plate and the platform. The jaw mechanism may be carried on an arm or arms (13) which can be raised and lowered. Side plates (32) and a rear gate (80) may be provided on the crusher jaw mechanism to contain light scrap. The jaws may be tiltable, and may be provided with front fork tines (71) to act as an entry ramp and for manipulating the body shells before and after flattening.

22 Claims, 8 Drawing Figures

MOBILE CRUSHER VEHICLE

This invention relates to a mobile crusher vehicle, and particularly a vehicle that is suitable for crushing motor vehicle bodies, especially car body shells.

The metal content of scrap car body shells can be reclaimed if the body shell is transported to a plant for that purpose. Commonly, various components of the car are first removed; these include the engine, gearbox, transmission and road wheels as well as the seats and electrical wiring. The stripped shell is almost as bulky as the original car, but weighs much less, typically 300 kg. The volume capacity of a truck for transporting the shells to a reclamation plant may be, for example, only six shells, which is likely to represent a highly inefficient under-utilisation of the truck's weight-carrying capacity.

If the body shells are first compressed to a height of 15 to 30 cm., the truck may be able to carry about five times as many shells in a single journey to the reclamation plant. In addition, crushing can be useful in order to save space in a scrapyard. Suitable car body shell crushing machinery has until now been very expensive, has tended to be immovable or inconvenient to move and has required separate means, including the use of a vehicle to carry the shells, to feed the crusher. U.S. Pat. No. 3,266,413 describes a car body crushing machine that is transportable, in that it can be winched on to a truck bed for transportation, but it is effectively static once it has been delivered to a site and set up for use.

U.S. Pat. No. 3,486,440 describes a machine permanently mounted on a truck bed. Folding platforms are provided on either side of the truck for use during car body flattening, which severely limit its manoeuverability in, for example, a car scrapyard.

The prior art body crushing machines require distinct handling equipment for the body shells; that is to say, it is necessary to provide additional machinery to shift the car bodies and load them into the crusher jaws of the machines.

According to the present invention there is provided a mobile crusher vehicle comprising a vehicle body and a crusher jaw mechanism mounted in a forward position thereon, i.e. in a position in which the crusher jaw mechanism can be carried ahead of the vehicle body in one of the possible directions in which the vehicle is capable of being propelled, the crusher jaw mechanism comprising a platform on which an object to be crushed can be carried, a press plate mounted above the platform and closure means for urging the plate and the platform towards one another whereby to crush a said object on the platform.

The present invention also provides a method of crushing an object, comprising providing a vehicle having a crusher jaw mechanism mounted in a forward position thereon, the crusher jaw mechanism comprising a platform, a press plate and closure means for urging the plate and the platform towards one another, advancing the vehicle forwards towards the object and driving the platform under the object to load the object on to the platform, and crushing the object between the press plate and the platform.

The object to be crushed may be a car body shell, and will generally be referred to as such in the following description, but it should be understood that other objects may usefully be crushed by the operation of such a vehicle, including scrap household appliances such as cookers, refrigerators and washing machines.

A crusher vehicle in accordance with the invention, in which the crusher jaws including a platform can be carried ahead of the vehicle, can be effectively self-loading. The vehicle can be driven towards a body shell until the platform has been run under the shell, and the shell will then be in position to be crushed. The crusher can be driven to the body shell, thus eliminating the need for a separate vehicle to transport the shell to the crusher.

The crusher vehicle is preferably provided with means for altering the height of the platform with respect to the vehicle body. The range of height adjustment preferably covers at least from ground level, for driving the platform under objects standing on the ground, to a height which will give adequate ground clearance when driving the vehicle. A higher platform level is useful to enable the vehicle to be used for picking up body shells from a stack, and for loading the crushed body shells on to a transporter vehicle for taking them directly to a reclamation plant.

The crusher jaw mechanism may to this end be carried on an arm or arms extending forwardly from a pivotal mounting point or points on the vehicle body, means being provided for raising and lowering the arm or arms to raise or lower the crusher jaw mechanism.

The vehicle is preferably also provided with means for tilting the platform. Some such means may tilt only the platform, while other such means may tilt the entire crusher jaw mechanism. The platform is preferably tiltable as far as a vertical position, with respect to the vehicle body, either backwards or forwards, but most preferably backwards towards the vehicle body. Such a tilting facility can be useful when an operator wishes to adjust the position of a body shell between the jaws, and it is especially useful in conjunction with means for raising the platform for unloading the compressed shell from the jaws by tilting the raised platform and then opening the jaws to allow the compressed shell to slide or drop out.

The crusher jaw mechanism may advantageously be provided with tines extending forward of the platform. Such tines are useful for manipulating a body shell before it is picked up in the crusher jaws, for providing a relatively lightweight forward extension of the platform to support part of a long body shell or other object if it is not fully on the platform, and for handling the shell after it has been compressed including loading it with others on to a truck for onward transport.

The vehicle body may be wheeled or tracked and may be rigid or articulated. It will normally be self-propelled. Especially suitable vehicle bodies are those that are commonly used in heavy duty front loading machines which are often fitted with a fork, grab or bucket on a power driven arm. The mechanism for driving the arm may in such a case usually be simply adapted for controlling the height of the platform in the crusher jaw and for tilting it. Moreover, such bodies are usually provided with a hydraulic pump and controls which can be adapted to control hydraulic rams in the mobile crusher vehicle.

Although hydraulic means are normally preferred for urging the press plate and the platform towards one another, and for altering the height of the platform, tilting the platform and carrying out other operations to be described hereinafter, other means including pneumatic or mechanical drive means may sometimes be more suitable.

The means for urging the press plate and platform towards each other are preferably such that the plate can be positioned parallel to the platform, so that compressed shells can be formed with parallel top and bottom surfaces to aid subsequent stacking. However, it is also preferred that one of the plate and the platform can be tilted relative to the other. Both of these features can be achieved in a crusher jaw mechanism which comprises a hinge connection between the platform and the press plate, the plane of one or both of the platform and the plate being offset from the hinge axis such that the platform and plate can be positioned simultaneously parallel to one another and spaced apart. The distance between the plate and the platform when they are parallel corresponds to the thickness of the crushed object, if it is crushed to leave parallel top and bottom faces. A distance of 15 to 30 cm. is accordingly preferred in a crusher intended for use on car body shells.

When opened beyond the parallel configuration, such hinged jaws are inclined at an angle to each other. This allows a car body shell to be taken into the jaws on the platform until it abuts the sloping press plate, possibly with a slight preliminary crushing of the leading end depending on the force with which it was loaded into the crusher jaws. If the platform and plate are not so large as to crush the entire body shell in one closure of the jaws, but only to crush the leading end, the jaws can be reopened and the partially crushed body shell loaded further into the jaws until the uncrushed part abuts the sloping crusher plate, and the jaws then closed again. This can be repeated as often as necessary, depending on the length of the object to be crushed and the lengths of the platform and press plate.

The further loading of the partially crushed shell into the jaws is preferably accomplished by tilting the platform and allowing the shell to slide further into the jaws. It is of course necessary to ensure that there is no obstruction to the forward movement of the crushed portion of the shell between the inclined press plate and the platform.

Guides may also be provided at the sides of the platform to help control a car body shell as it passes into and out of the jaws. The guides or side pieces are preferably not parallel, so that the crushed shell can be released towards the wider end, which is most preferably at the rear of the crusher, i.e. the end nearer the vehicle body.

Preferably, the press plate has a generally planar working surface. This is intended to denote that the overall configuration of the surface is planar, although the surface may be profiled or textured for the purpose of providing non-slip or similar properties, as found for example on steel flooring plates.

The crusher jaw mechanism may be provided with a grab movable with the press plate capable of extending forwardly and downwardly for gripping the engine of a car. By raising the press plate the engine and gearbox of the car may then be removed, especially if the car body is held down by fork tines extending forward of the platform. Use of the mechanism provided for opening the jaws as the means for raising the engine grab makes it possible to dispense with the separate hydraulic piston and cylinder and associated controls that have previously been needed in an effective engine puller.

The rear of the crusher jaw mechanism may be open or closed, but may with advantage be provided with an openable gate, especially when the aforementioned side pieces are also present, in which case the crusher jaw is effectively an open fronted box when the gate is closed. It can then be loaded with smaller scrap objects. Such light scrap includes scrap household appliances such as cookers, refrigerators and washing machines and other scrap metal such as oil drums and cans, as well as loose car doors, bonnets (hoods), hub caps and other trim from the scrapyard. The gate preferably comprises spaced bars, and can be opened clear of the platform. A crusher formed as a box in this way is preferably also tiltable so that the box opening is on the highest side, for loading, and the gate is underneath, for discharging.

A mobile crusher vehicle in accordance with the present invention is illustrated by way of example in the accompanying drawings, which show only the jaw mechanism in any detail, the vehicle bodies being more generally indicated, omitting conventional details and hydraulic connections.

Figure 1:
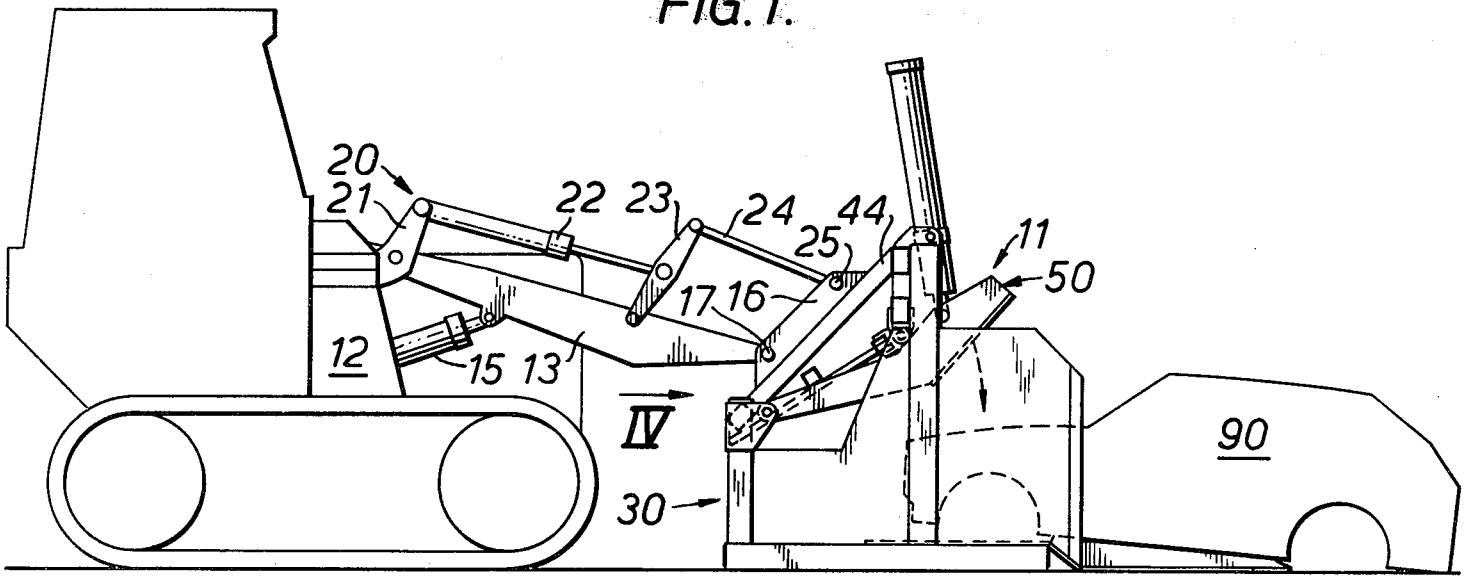
FIG. 1 is a side elevation of a crusher vehicle having the jaw mechanism mounted thereon, with a car body shell partially on the platform, before crushing.

In FIG. 1 the crusher jaw mechanism 11 is mounted on a conventional track-laying tractor body 12 as used in a heavy duty front loading machine, provided with a diesel engine, a drive transmission, a hydraulic power supply and controls, and an operator's cab. A pair of parallel laterally spaced main lifting arms 13 extend forwardly on either side of the tractor body and engage mounting plates 16 on the crusher jaws by means of pivot pins 17. The arms 13 pivot on the tractor body so that they can be raised and lowered thereon by hydraulic piston and cylinder assemblies 15 associated with each arm, in order to raise or lower the jaw mechanism.

Associated with each main lifting arm 13 is a secondary linkage 20 controlling the tilt of the crusher jaws. The linkage 20 includes a link 21, pivoted at one end to the tractor body, at its mid-point to the main arm and at its other end to a hydraulic piston and cylinder assembly 22. This couples the link 21 to the mid-point of a further link 23, which has one end connected to the main arm to complete an approximately parallel linkage depending on the precise extension of the piston and cylinder 22. The other end of the link 23, remote from the main arm, is coupled through a bar 24 to the mounting plates 16 by means of a pivot pin 25, to complete a second substantially parallel linkage.

The piston and cylinder 22 can be extended to tilt the crusher jaw mechanism towards its fully forward position, in which it would be tilted somewhat forward of the horizontal orientation shown in FIG. 1. Contraction of the assembly 22 would rotate the jaw mechanism towards its fully back position, in which it would be tilted back to an orientation that is near vertical or leaning back beyond vertical.

The generally parallel nature of the secondary linkage 20 is such that raising or lowering the main lifting arms 13 does not substantially alter the tilt of the crusher jaw mechanism. Variations on this kind of linkage are well known in the front loading machine art for the purpose of raising or lowering a bucket, shovel or fork without tilting it, and are acceptable alternatives to the linkage shown.

The jaw mechanism as illustrated in FIGS. 1 to 7 comprises a rigid frame structure 30 including a crushing platform 31 and side plates 32, a pivoted upper jaw member 50 mounted in the frame between the side plates and over the platform, hydraulic drive means for the upper jaw member and an auxiliary rear gate 80 having an associated opening and closing mechanism.

The frame structure 30 is a welded steel fabrication of plates and rectangular hollow sections. The platform 31, which forms part of a fixed lower jaw member, is carried on a framework comprising a front cross member (not shown) and a rear cross member 34, joined by side members 35 extending rearwardly beyond the platform and rear cross member. Further similar members provide reinforcement under the platform.

A pair of front columns 36 stand one on either side of the platform and are joined at their top ends by an overhead main cross beam 37, and below the main beam by a secondary cross beam 38. A pair of shorter rear columns 40 stand one on each rear end of the side members 35 and are joined at their upper ends by a rear overhead cross beam 41. A pair of laterally spaced inclined mounting beams 44 extend from the rear overhead cross beam forwardly and upwardly to the main overhead cross beam, and carry the mounting plates 16.

The space between the rear overhead cross beam 41 and the rear edge of the platform 31 is essentially unobstructed and defines a clear rear exit from the jaw mechanism, bounded at either side by the rear columns 40 and the rear ends of the side members 35.

The side members 35 also carry vertical side plates 32, which are reinforced by the columns 36 and 40. These side plates enclose the sides of the jaw mechanism. Each side plate has an outwardly flared front vertical edge 33 to assist in guiding a car body shell or the like into the jaws. In order to avoid a crushed body shell jamming in the jaws as a result of lateral spreading, the side plates are not parallel, but are set at a shallow angle such that the distance between them steadily increases from the front to the back of the jaw mechanism 11. Suitable angles are 1° or more on each side, between 1° and 2° or 3° being commonly adequate, which corresponds to an outward displacement of the rear end of each side plate of about 1 cm. or more in every meter length.

A guide ramp 70 is provided at the front edge of the platform 31. Mounted on the ramp ahead of the platform are a pair of laterally spaced forwardly extending fork tines 71 of inverted T section. The side flanges 72 of the tines taper in at their tips towards the upright web 73, each of which is tapered throughout its full length, rising from a point at the front tip, initially steeply and thereafter gradually to a highest point above the rear edge of the ramp and the front edge of the platform, and finally dropping sharply back to terminate at platform level.

The upper jaw 50 comprises two pairs of parallel cranked arms 51 connected at the head of the jaw by a rectangular framework of beams 52 which provides support and reinforcement for a press plate 55 carried on the lower face of the framework. The rearmost crossbeam of the framework carries on its rear face, between the two pairs of cranked arms, a series of triangular auxiliary plates 56 angled upwards at about 45° and reinforced by gusset plates 57.

The upper jaw is mounted in the rigid lower jaw frame structure 30 by means of pivot pins 47 which hold the rear ends of the cranked arms 51 in brackets 48 carried on the tops of the rear columns 40 and on the ends of the rear overhead cross beam 41.

Movement of the upper jaw in the frame structure 30 is controlled by a hydraulic cylinder 60 pivotally mounted between pairs of plates 61 at each end of the two forward cross beams 37 and 38. Piston rods 62 are connected to the head of the upper jaw above the press plate 55 by means of pins 63 located between each pair of cranked arms 51. The cylinders are mounted so that it is the expansion stroke of the piston that drives the press plate towards the platform 31, and the less powerful contraction stroke that raises the press plate thereafter. The cylinders are so positioned in the jaw mechanism that, on expansion to extend the piston rods, the approximate midpoint of the press plate in the upper jaw is thrust directly towards the approximate midpoint of the platform in the lower jaw, thereby maximising the efficiency of the jaw as a crushing mechanism.

The arms 51 in the upper jaw for carrying the press plate are cranked at an angle of 30°–35°. In the embodiments of the invention illustrated, which are intended for flattening scrap car body shells in particular, the pins 47 about which the upper jaw rotates are set at a height of about 80 cm. above the level of the platform, and are about 1 m. from the rear edge of the press plate. As a result, the press plate is parallel with the platform when the upper jaw is closed to about 15 cm. from the platform (FIG. 2), which is considered a desirable thickness for the flattened body shell. However, the jaws can still crush and discharge a car body that has not been stripped of relatively incompressible components, such as engine, gearbox and axles, or even a complete car, because of the vertical clearance of 65–80 cm. below the rear cross beam 41 to platform level and the even greater total clearance of up to 1 m. between the rear cross beam and the rear edge of the platform. When the upper jaw is fully raised, there is a clearance of at least 90 cm. between the rear edge of the platform and the nearest parts of the upper jaw, which are points on the arms 51.

Since the axis about which the upper jaw rotates, namely the axis of the pins 47, is parallel to both the plane of the press plate and the plane of the platform, and lies above both when the press plate and platform are parallel (considering their horizontal orientation) the movement of the press plate towards the platform has a rearward component during the final stage, when the press plate is below the said axis. This has the benefit of tending to draw the body shell or other object being crushed into the jaw mechanism, to counter any tendency to squeeze the object back out of the jaws. When the upper jaw is raised to its maximum extent (FIGS. 1, 3 and 8), in which position the arms 51 are in abutment with the secondary cross beam 38, the press plate is angled upwards at about 45°–50° to the horizontal and the triangular auxiliary plates 56 are near parallel to the platform, and substantially the whole of the upper jaw member 50 is above its axis of rotation, the press plate can act as a solid deflector which is capable of effecting a preliminary crushing of any high body shell, such as that of a large car or van, which is rammed into the jaws. As illustrated, the leading edge of the press plate in this position is about 140–150 cm. above the platform, and the rear edge is about 90 cm. above the platform.

The jaw mechanism 11 is shown (FIGS. 1 to 7) fitted with an optional rear gate 80 between the front columns 36 behind the press plate. The gate is pivoted on hinge pins 85 in plates 84 mounted on the secondary cross beam 38, and can quickly be disconnected when not required by removing the hinge pins. The gate comprises an array of steel bars 81 extending downwardly from a horizontal beam 82 and reinforced by a second, lower, horizontal beam 83. The gate is actuated by a hydraulic cylinder 86 mounted in plates 87 carried on the two front cross beams 37 and 38, which has a piston rod 88 connected to a pair of plates 89 carried on the two gate beams 82 and 83. The gate is movable between a closed position (FIGS. 4, 6 and 7) in which the bars are substantially vertical when the platform is horizontal, and an open position (FIGS. 1 to 3), in which the bars are angled backwards as far as the rear cross beam 41 and leave the rear exit from the jaw mechanism substantially unobstructed.

The auxiliary plates 56 at the rear of the press plate 55 extend between each adjacent pair of bars 81 in the gate 80. These auxiliary plates prevent the upper jaw becoming jammed by small pieces of scrap which might otherwise get between the rear of the press plate and the gate when the gate is farthest away from the plate, i.e. when it is at the same height above the platform as the pivot pins 47, and preventing the plate from moving rearwards as it is closed further towards the platform.

The jaw mechanism 11 is suitably made of steel, and may be of welded construction. The platform 31 and the press plate 55 are suitably of tough, abrasion-resistant steel plate; the tines 71 and the bars 81 may be of high yield, high tensile steel.

Figure 2:
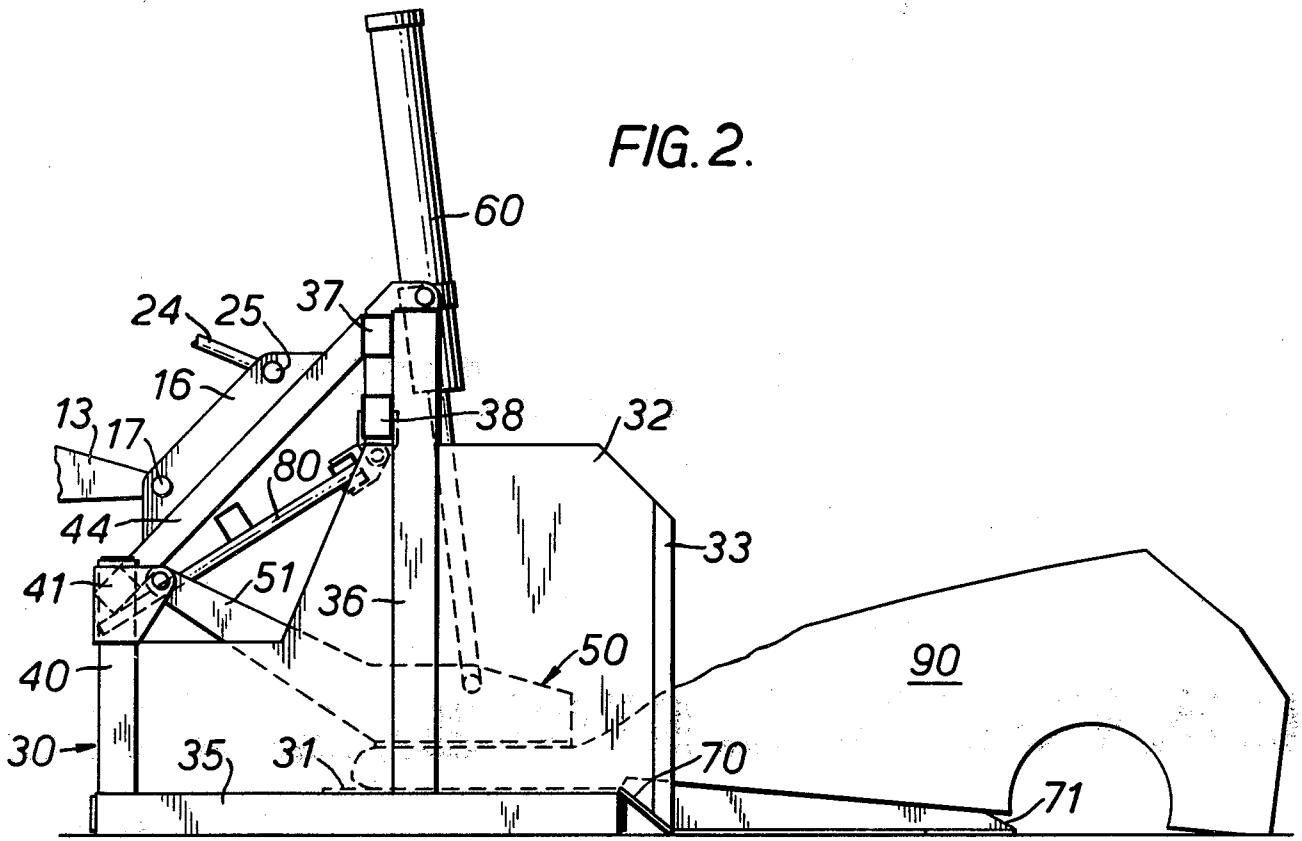
FIG. 2 is a side elevation, to a larger scale, of the jaw mechanism after a first closure of the jaw to crush the leading end of the car body shell.
Figure 3:
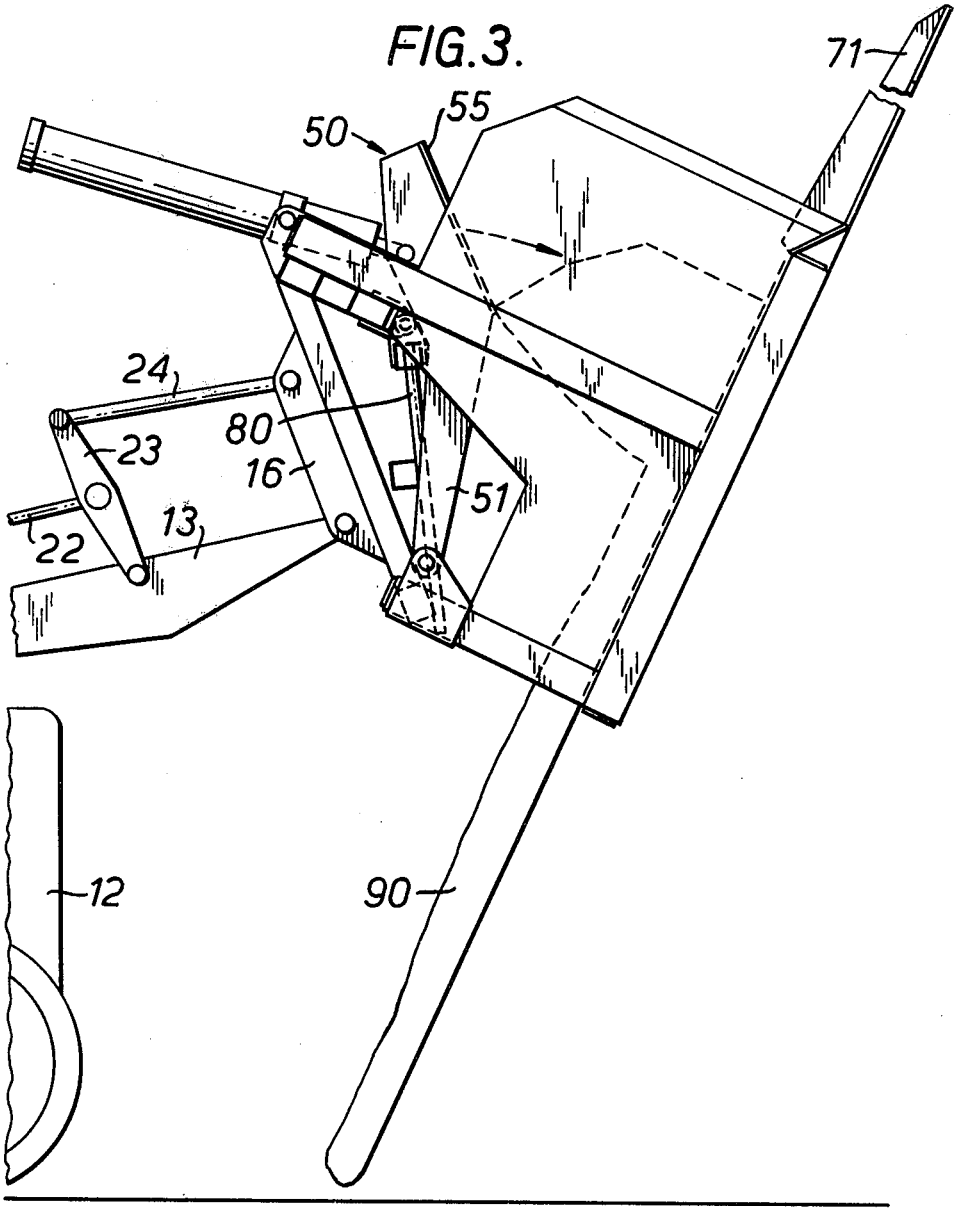
FIG. 3 is a side elevation of the jaw mechanism before the final closure of the jaws to crush the rear end of the body shell.
Figure 4:
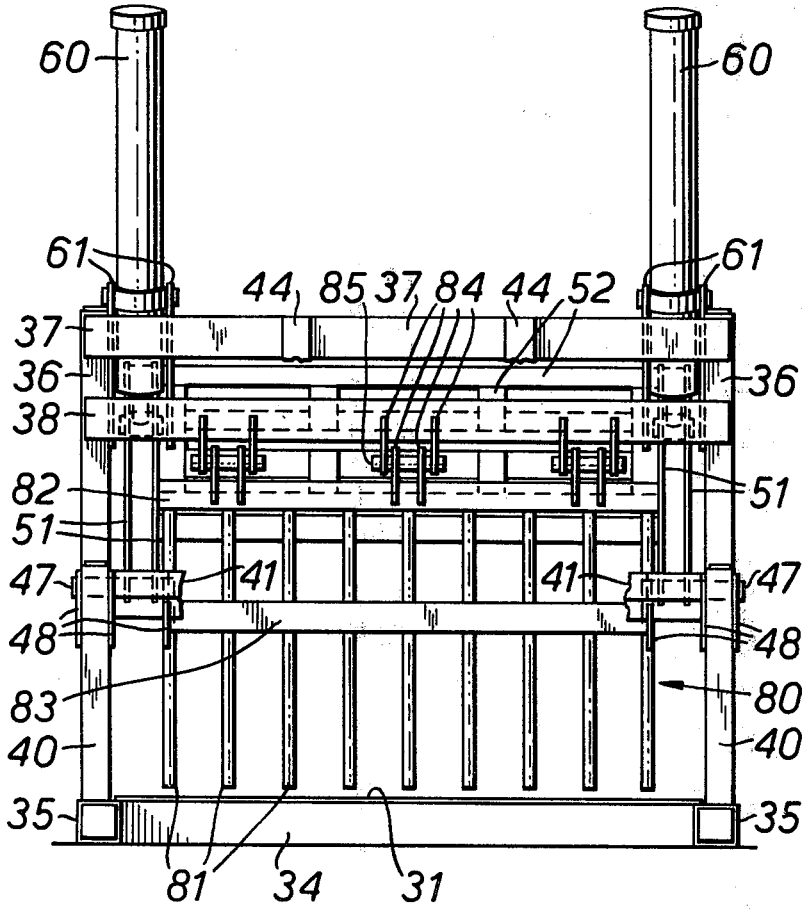
FIG. 4 is a rear elevation of the jaw mechanism, partly broken away, taken in the direction of the arrow IV shown in FIG. 1.

The use of the crusher jaw mechanism to flatten car body shells is shown in FIGS. 1 to 3. The tractor is first driven forwards with the jaw mechanism 11 lowered and the platform 31 level or inclined slightly down at the front so that the tines 71 are run under the car body 90 to raise it to platform height. The tines act as two very narrow ramps which probe under the car body which, if the wheels have been removed, will typically be resting on rough ground or concrete. Because they are much narrower than a single broad ramp, they are very much less likely to snag on the usual projections under the body shell, and if they do snag, they can be withdrawn by reversing the tractor and then run under the shell again in a slightly different location. The vertical webs 73 of the tines rise to a higher level than the platform so that as they are run under the body shell it is lifted high enough to allow any downwardly projecting or hanging parts of the shell to clear the leading edge of the platform, with assistance from the guide ramp 70 if necessary.

With the jaws open, and an obstacle if necessary behind the car body 90 to prevent its moving backwards, the body shell is forced on to the platform until it abuts the open press plate 55. FIG. 1 shows the upper jaw 50 fully open at this stage; normally, the upper jaw is only opened to raise the press plate sufficiently to admit the body shell to the jaws; the extent to which the upper jaw is opened accordingly depends on the size of the body shell. The initial impact of the angled press plate on the front of the shell may cause some preliminary crushing, and establishes that the shell is correctly located on the platform.

The tractor is then halted and the press plate closed (FIG. 2), flattening the front end of the body shell 90 in one single action, then reopened; the tractor is again run forward until an uncrushed part of the body shell abuts the press plate; after crushing again in a single movement, opening the jaw and running the tractor forward again, the body shell will probably be far enough over the tines 71 and on to the platform 31 to remain in the jaw mechanism when it is then raised and tilted back to allow gravity to slide the body shell further back into the jaws (FIG. 3). The last sections of the body shell can be crushed with its leading end resting on the ground, or raised in the air; the jaws can then be finally opened and the crusher mechanism raised further and tilted to vertical to allow the flattened shell to drop to the ground. It can then be stacked flat, or on end, using the tines and the front of the platform to manipulate and lift it; it can even be gripped in the jaws to move it.

It is also possible to use the whole crusher jaw mechanism 11 carried at the end of the lifting arms 13 to give scrap body shells a preliminary flattening by means of the dead weight of the jaws, pressing down on the body shells, especially the roofs, with the underside of frame 30 below the platform 31. The tines 71 can be used to stack two or three such treated shells together, and they can all be flattened together in the jaws in the same manner as previously described.

The throughput rate of the jaw mechanism is governed largely by the hydraulic pump capacity. An oil flow of 180 l./min. can enable 15 to 20 car body shells per hour to be flattened. This rate can be doubled at double the oil flow. By first staving in the car roofs and then flattening the shells in pairs, a skilled operator can achieve very high throughput rates.

Figure 5:
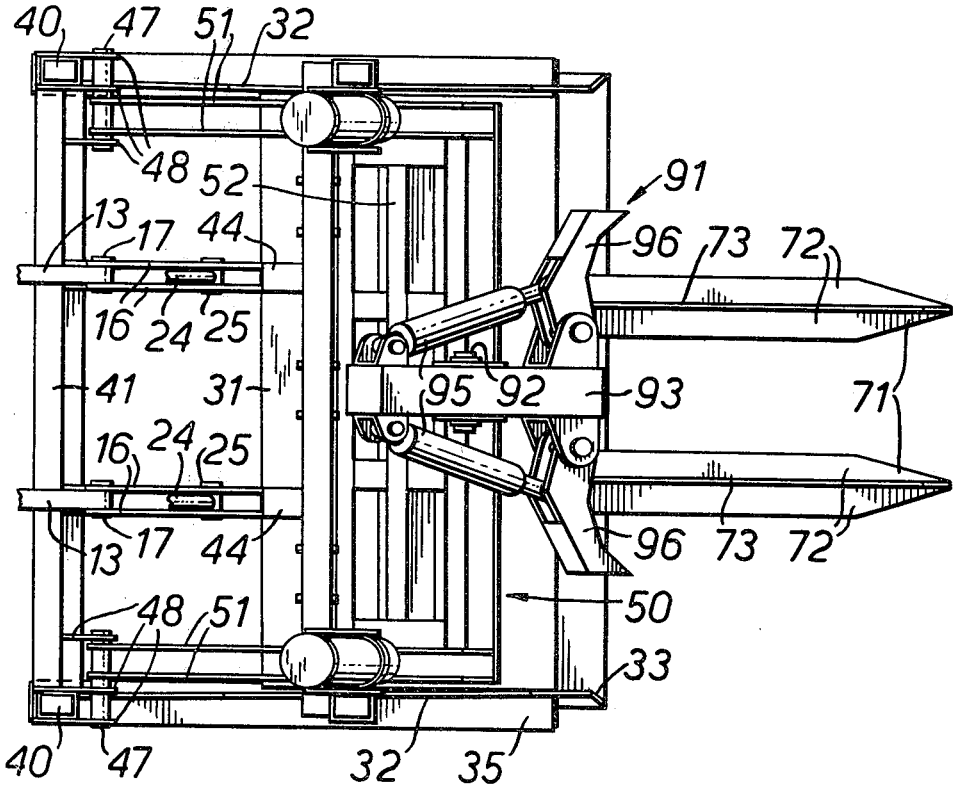
FIG. 5 is a plan view of the same jaw mechanism modified by the addition of an engine and transmission puller.
Figure 7:
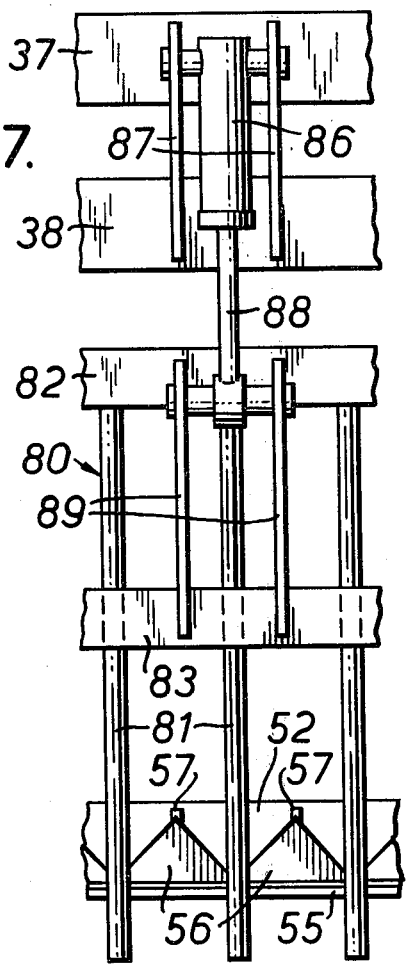
FIG. 7 is a fragmentary rear elevation of the jaw mechanism also illustrating the further components shown in FIG. 6.
Figure 6:
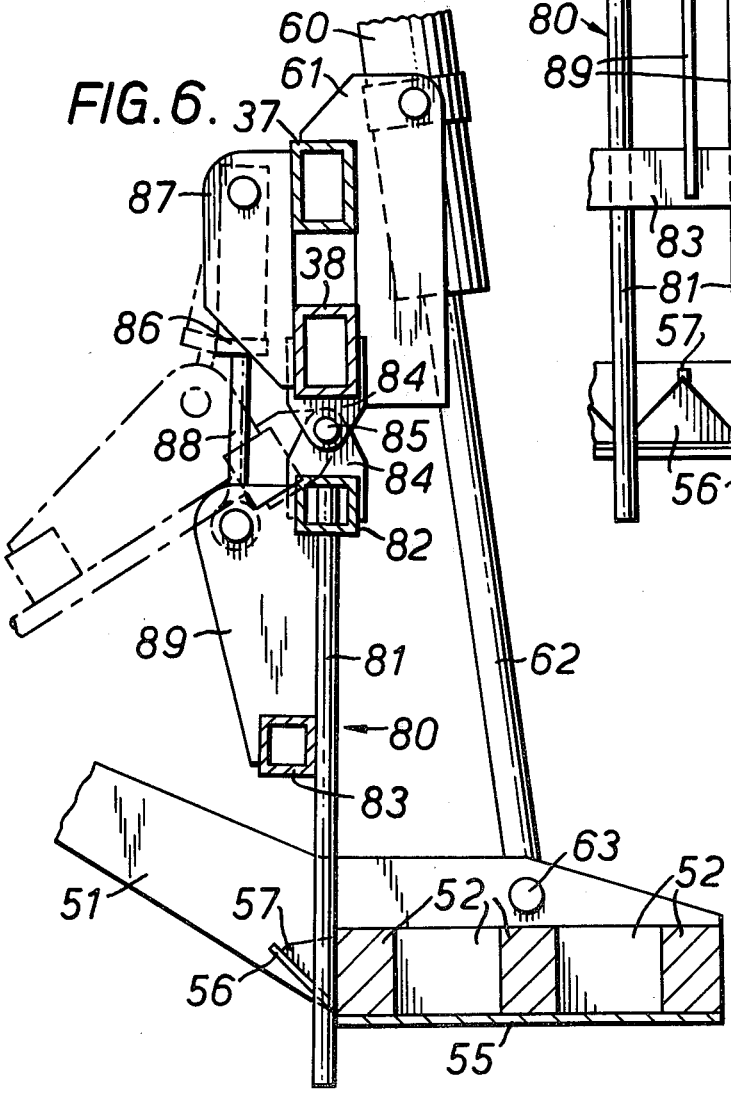
FIG. 6 is a fragmentary view to a further enlarged scale of part of the jaw mechanism in the position shown in FIG. 2, but in longitudinal section and showing further components relating to a rear gate.

FIG. 5 shows an engine grab 91 pivotally mounted in a bracket 92 on the front edge of the upper jaw member 50. A hydraulic ram (not visible in the drawing) located behind the bracket 92 acts to tilt a body member 93, which carries pincer grab jaws 96 powered by two hydraulic rams 95, between a forward lowered operative position and a rearward retracted position.

A car engine can be removed by opening the car bonnet (hood) with one of the tines 71, positioning the tines above the car wings on either side of the engine compartment, tilting the engine grab forward into its operative position, lowering the upper jaw member 50 to insert the grab into the engine compartment, closing the grab jaws 96 to grip the engine, and opening the jaw mechanism to pull the engine and any attached car transmission components from the car body while holding the body shell down with the tines.

The above sequences for crushing car body shells take place with the rear gate 80 held open, or removed entirely: it is not required for this purpose. When the gate is shut, light scrap can be crushed. The crusher jaw mechanism will then normally be held in the tilted back position and filled by hand, with a magnet or by means of a grapple before crushing. It can then be unloaded by opening the gate, at a convenient location; or else more scrap can be added and compressed together with the previously compacted scrap before unloading, to build up a larger bale.

The hydraulic piston and cylinder assemblies used in the machine are all double acting, and can accordingly be driven and controlled on both their expansion and contraction strokes. Hydraulic power is taken from an oil pump in the tractor, and controlled from the cab, in the same way as in a conventional front loading machine.

The flattened scrap produced by the jaw mechanism is in a condition that is suitable both for economical transportation and for fragmentisation, for example after cooling in liquid nitrogen, as a preliminary to reclamation of the different valuable materials contained in it.

Figure 8:
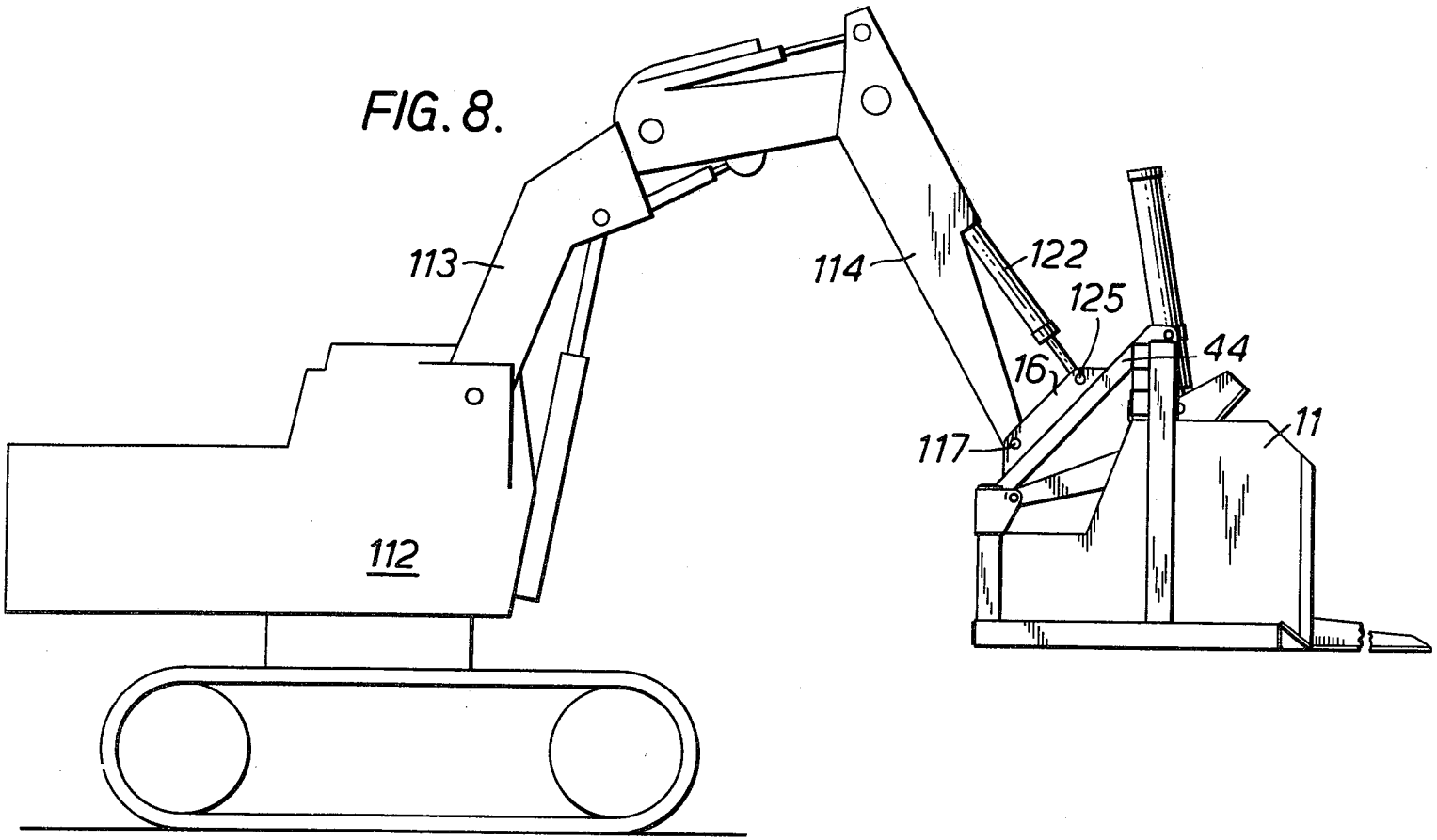
FIG. 8 is a side elevation of a different crusher vehicle having the jaw mechanism mounted thereon, wherein the jaws are movable towards and away from, and rotatable about, the vehicle body.

In FIG. 8 the crusher jaw mechanism 11 is carried on a different vehicle body 112, which in this case is a conventional tracked excavator body with a 360° slewing facility, carrying a single multi-section hydraulically articulated jib 113 engaged with a single bar 117 extending between the mounting plates 16 across the two inclined beams 44 on the jaw mechanism.

Tilting is controlled by a hydraulic piston and cylinder assembly 122 mounted on the final section 114 of the jib 113 and engaged with a bar 125 between the mounting plates 16. The jaws can be tilted through the same range of movement as before, between a forward inclination below horizontal and a backward tilt beyond vertical, making use of the full articulation of the jib. The linkages in the jib sections are also arranged as is well known in the art of excavator construction so that the jaws can be moved on the end section 114 without altering their tilt.

The jaws can be moved up and down, as before, and in addition can be moved forwards and backwards, and in rotation about the vehicle body, without the vehicle moving on its tracks. Thus while the crushing action is identical, this vehicle as a whole is more versatile; it is, for example, capable of travelling along the aisles of a scrapyard and collecting car bodies from either side and at any height. It is similarly more flexible in unloading the flattened bodies, and loading them on to a waiting transporter.

The rear gate 80 and the engine puller 90 can also be used on this vehicle, although they are not shown in FIG. 8.

I claim:

1. A mobile crusher vehicle comprising a vehicle body and a crusher jaw mechanism mounted in a forward position thereon, the crusher jaw mechanism comprising a platform affixed thereto on which an object to be crushed can be carried, a press plate mounted above the platform and closure means for urging the plate and the platform towards one another whereby to crush a said object on the platform, wherein the platform comprises a leading edge provided with guide means for loading a said object onto the platform by advancing the vehicle forwardly towards the object and driving the guide means and the platform under the object.

2. A vehicle as claimd in claim 1, further comprising means for altering the height of the platform with respect to the vehicle body.

3. A vehicle as claimed in claim 2, wherein the crusher jaw mechanism is carried on at least one arm extending forwardly from a pivotal mounting point on the vehicle body, means being provided for raising and lowering the at least one arm.

4. A vehicle as claimed in claim 2, further comprising means for tilting the platform.

5. A vehicle as claimed in claim 4, wherein the said tilting means is adapted to tilt the entire crusher jaw mechanism.

6. A vehicle as claimed in claim 4, wherein the platform is tiltable backwards with respect to the vehicle body as far as a vertical position.

7. A vehicle as claimed in claim 1, wherein the press plate has a generally planar working surface.

8. A vehicle as claimed in claim 7, wherein the closure means is adapted to urge the press plate and platform into parallel orientations.

9. A vehicle as claimed in claim 8, wherein one of the press plate and the platform can be tilted relative to the other.

10. A vehicle as claimed in claim 7, wherein the crusher jaw mechanism comprises a hinge connection between the platform and the press plate, and the axis of the hinge is so positioned in the jaw mechanism that, when the jaw is closed, the plane of the press plate lies between the hinge axis and the plane of the platform.

11. A vehicle as claimed in claim 1, wherein the jaw mechanism is open or openable at the rear to discharge the crushed object.

12. A vehicle as claimed in claim 11, comprising side pieces to guide and contain the object on either side of the jaw mechanism.

13. A vehicle as claimed in claim 12, comprising an openable gate at the rear of the platform, to prevent the discharge of the object from the rear of the platform until the gate is opened.

14. A vehicle as claimed in claim 1, further comprising an engine puller movable with the press plate.

15. A vehicle as claimed in claim 1, wherein the crusher jaw mechanism is movable towards and away from the vehicle body.

16. A vehicle as claimed in claim 1, wherein the crusher jaw mechanism is rotatable about the vehicle body.

17. A vehicle as claimed in claim 1, wherein the guide means includes a guide ramp disposed at the leading edge of the platform.

18. A vehicle as claimed in claim 1, wherein the guide means includes a pair of laterally spaced tapered and pointed fork tines extending forwardly from the leading edge of the platform.

19. A method of crushing an object, comprising providing a vehicle having a crusher jaw mechanism mounted in a forward position thereon, the crusher jaws mechanism comprising a platform affixed thereto, a press plate and closure means for urging the plate and the platform towards one another, the platform having a leading edge provided with guide means for the object, advancing the vehicle forwardly towards the object to drive the guide means and the platform under the object to load the object onto the platform, and crushing the object between the press plate and the platform.

20. A method as claimed in claim 19, including the step of adjusting the position of the object on the platform by tilting the platform.

21. A method as claimed in claim 19, wherein the crushed object is unloaded from the crusher jaw mechanism by tilting the platform.

22. A method as claimed in claim 19, wherein the object is a car body.

* * * * *